US005954561A

United States Patent [19]

Cannone

[11] Patent Number: 5,954,561

[45] Date of Patent: Sep. 21, 1999

[54] PLAY MATERIAL CONTAINER HAVING PLURAL PLAY FEATURES

[75] Inventor: Gregory M. Cannone, Santa Monica, Calif.

[73] Assignee: Mattel, Inc., El Segundo, Calif.

[21] Appl. No.: 08/887,853

[22] Filed: Jul. 3, 1997

[51] Int. Cl.[6] ..... A63H 33/04

[52] U.S. Cl. ..... 446/75; 446/70; 446/71; 446/74; 446/75; 446/76; 446/476; 446/479; 446/480; 446/481; 446/491; 446/385; 434/82; 434/127; 434/159

[58] Field of Search ..... 446/70, 71, 74, 446/75, 76, 267, 476, 479, 480, 481, 491, 385; 434/82, 127, 159

[56] References Cited

U.S. PATENT DOCUMENTS

| | | | |
|---|---|---|---|
| 1,458,508 | 6/1923 | Aiken . | |
| 2,278,124 | 3/1942 | Kowinski | 446/75 X |
| 2,831,286 | 4/1958 | Eisner | 434/82 X |
| 3,921,801 | 11/1975 | Sway . | |
| 4,961,717 | 10/1990 | Hickey | 446/76 |
| 4,988,321 | 1/1991 | Goldfarb . | |
| 5,088,598 | 2/1992 | Iguchi | 434/82 X |
| 5,139,453 | 8/1992 | Aiken et al. | 446/74 X |
| 5,306,192 | 4/1994 | Caveza et al. | 446/481 X |
| 5,314,373 | 5/1994 | Caveza et al. | 446/481 |
| 5,346,423 | 9/1994 | Caveza et al. | 446/479 |
| 5,387,149 | 2/1995 | Caveza | 446/491 X |
| 5,480,335 | 1/1996 | Caveza | 446/491 X |
| 5,674,103 | 10/1997 | Bean | 446/75 |

FOREIGN PATENT DOCUMENTS

| | | | |
|---|---|---|---|
| 243125 | 12/1946 | Switzerland | 446/75 |

*Primary Examiner*—Robert A. Hafer
*Assistant Examiner*—D Neal Muir
*Attorney, Agent, or Firm*—Roy A. Ekstrand

[57] ABSTRACT

A play material container includes a base having an interior cavity, a sidewall and a cookie-cutter edge defining a predetermined shape. A lid is configured to be snap-fitted upon the base to provide container closure. An extrusion die is formed in the container base sidewall which is capped by a resiliently supported cap secured to the container lid. The container lid defines an upper surface supporting a plurality of open face press molds. The cookie-cutter shape, the press mold elements, and the extrusion die aperture are preferably coordinated in accordance with a common theme such as a food article or the like.

6 Claims, 2 Drawing Sheets

10
30
33
22
21
20
24
31
32
12
13
19
16
17
14
11
15
18
25

13
19
34
15
14
40
16
41
17
18
11
35

19
50
11
18
14

23
33
30
22
32
31
20
21
12
25
24

51
55
54
56
57
53
54
54
52

PLAY MATERIAL CONTAINER HAVING PLURAL PLAY FEATURES

FIELD OF THE INVENTION

This invention relates generally to malleable play material and particularly to containers and accessories used therewith.

BACKGROUND OF THE INVENTION

Malleable play materials have proven to be an extremely long-lasting and popular toy product. Such materials have varied considerably from earliest moldable or malleable materials which comprised mold simple modeling clay to later developed starch based materials and finally to present day play materials which are formed of complex synthetic and oil-based formulas. The result has been a succession of play material compounds which have provided both drying and nondrying material and which have provided a variety of textures or "feels" as they are handled by the user.

Not surprisingly, the popularity of such malleable play materials has encouraged practitioners in the toy arts to provide a similarly endless variety of accessories and toys to be used in various play patterns with these malleable materials. Examples of such accessories and toys have included extruders which typically operate in a hand press configuration to force the play material through an extrusion die. Similarly, various types of molds and forming tools have also been provided.

As practitioners in the toy arts have continued their endeavors to enhance the attractiveness of their play material products, the containers within which the play materials are sold and stored between use have also been subject to substantial design variation. As a result, containers for colorful play materials have included clear transparent containers intended to amply show the colorful play material as well as multiply colored and variously shaped play material containers. The basic objective in the continued development of play materials, accessories and toys used therewith, and containers for the play materials has been the enhancement of user appeal and play value.

An example of such creative work is found in U.S. Pat. No. 3,921,801 issued to Sway which sets forth a SELF-CONTAINED MOLDING KIT FOR HEAT LIQUIFIABLE MOLDING MATERIAL which includes a container for the molding material and a combination closure member mold which is releasibly secured to and carried by the container. The container is generally cylindrical and supports a quantity of moldable material together with an open top and closure lid. The lid conforms to and seals the open container and when removed provides a recessed open face mold for forming variously shaped articles. In some embodiments, a plurality of stackable or nesting container open face molds are further provided.

U.S. Pat. No. 4,988,321 issued to Goldfarb sets forth a SURPRISE AND LEARN MOLDING TOY having a housing supporting a plurality of mold cavities each of which defines a three-dimensional visually recognizable element such as a tree or a cat. Each cavity defines an entrance having a shape that corresponds to a two-dimensional visually recognizable element such as a letter. The two and three-dimensional elements for each cavity are generally related to each other to provide an associative value for the child user between an object formed or molded in the cavity and the letter on the door thereof.

U.S. Pat. No. 1,458,508 issued to Aiken sets forth a CLAY MODELING BOOK having a pair of book-like hinged portions defining interior faces. One face supports a quantity of molding clay while the opposite face supports a press mold. When the clay material is placed on one side of the book and the book is closed, an image corresponding to the press mold is formed in the modeling clay.

While the foregoing described prior art devices have provided various improvements and enhancements of play material toys and accessories and in some instances enjoyed commercial success, there remains nonetheless a continuing need in the art for evermore improved interesting and amusing play material accessories and toys.

SUMMARY OF THE INVENTION

Accordingly, it is a general object of the present invention to provide an improved play material container. It is a more particular object of the present invention to provide an improved play material container which in itself includes a plurality of interactive play features for use with the play material. It is a still further object of the present invention to provide an improved play material container which encourages and teaches the child user various mechanical and manipulative skills in working with the play material.

In accordance with the present invention, there is provided a play material container and multi-featured toy set comprising: a base defining a bottom and a base sidewall forming an interior cavity and a cutter edge formed on the sidewall; a lid defining a surface and surrounding lid sidewall shaped in general correspondence to and in a table with the cutter edge, the lid when secured to the base providing closure of the interior cavity; a plurality of open-faced press molds formed on the surface of the lid, each press mold shaped to form an object; an extrusion die formed in the side base sidewall having a die aperture formed therein; a cap formed to snap to the extrusion die and form a seal for the die aperture; and a quantity of amorphous malleable play material stored within the interior cavity.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
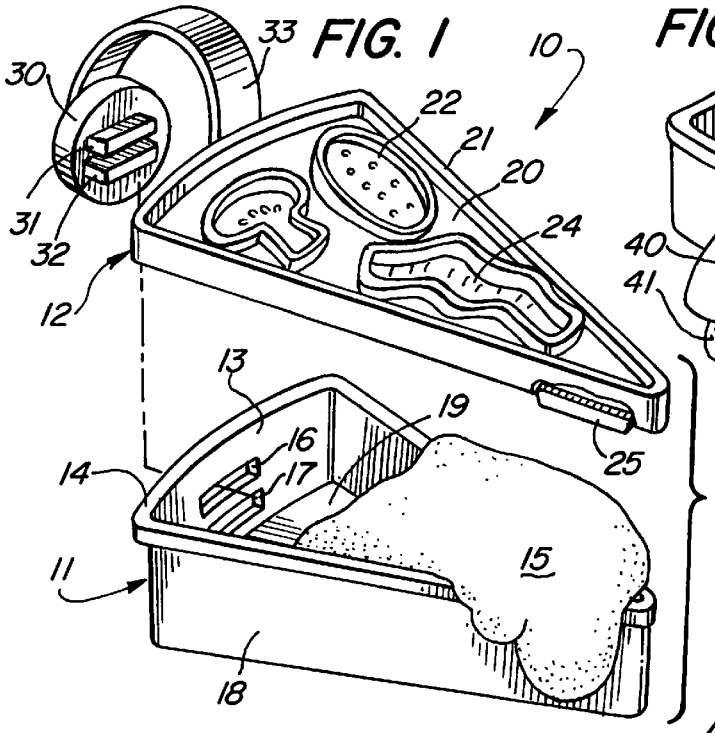
FIG. 1 sets forth a perspective assembly view of a play material container constructed in accordance with the present invention.

FIG. 1 sets forth a perspective assembly view of a play material container constructed in accordance with the present invention and generally referenced by numeral 10. Play material container 10 includes a base 11 and a lid 12 each correspondingly shaped to form a configuration generally corresponding to a pie segment. Thus, base 11 includes a sidewall 18 and a bottom surface 19 forming an interior cavity 13. Sidewall 18 further defines a pair of elongated generally parallel die apertures 16 and 17. Sidewall 18 terminates at its upper edge in a cutter edge 14 which, as is better seen in FIG. 3, allows base 11 to function in a "cookie-cutter" like fashion. In accordance with the play material container function of container 10, a quantity of malleable play material 15 is received within cavity 13.

Lid 12 is configured to be received upon and sealingly engage cutter edge 14 of base 11. Lid 12 defines a recessed surface 20 which provides the closure of cavity 13 when lid 12 is received upon cutter edge 14. A flexible hinge strap 33 extends from the rear portion of lid 12 and supports a generally cylindrical cap 30. Cap 30 defines a pair of extending seal bars 31 and 32 configured and sized to be snugly received within die apertures 16 and 17 respectively of base 11. The function of hinge strap 33 is to provide a flexible support for cap 30 which allows cap 30 to be snapped against die apertures 16 and 17 when lid 12 is closed upon base 11. As a result, die apertures 16 and 17 are closed by seal bars 31 and 32 maintaining the air tight seal of container 10 when lid 12 is installed upon base 11.

In further accordance with the present invention, lid 12 defines a sidewall 21 encircling recess surface 20. A plurality of open face press molds 22, 23 and 24 are formed upon recess surface 20. Lid 12 further supports a downwardly extending elongated cutter knife portion 25 which is sufficiently sharpedged to cut play material but which for safety purposes is not sharp-edged enough to cut objects such as the user's skin or the like.

In accordance with the container function of play material container 10, a quantity of play material 15 is received within cavity 13 and thereafter lid 12 is securely snap-fitted upon cutter edge 14 to provide closure and seal of the container. To prevent any drying of play material 15 due to apertures 16 and 17, cap 30 is forced against the rear portion of sidewall 18 with seal bars 31 and 32 aligned with die apertures 16 and 17. Sufficient pressure is applied to force seal bars 31 and 32 into die apertures 16 and 17 to complete the air tight seal of container 10. While container 10 may be fabricated of virtually any desired material, it has been found advantageous to fabricate both base 11 and lid 12 of a molded plastic material or the like.

Thus, it will be seen that play material container 10 functions properly as a shipping and storing container for a quantity of play material 15. In this roll, the physical appearance of play material container 10 enhances the eye appeal and interest value of the play material product.

In accordance with an important aspect of the present invention, play material container 10 also functions as an accessory toy in various play patterns using play material 15. The various play patterns are illustrated in FIGS. 2 through 5 below. However, suffice it to note here that, in its preferred form, play material container 10 is fabricated in accordance with a general "theme". In the example selected in the embodiment of FIG. 1, a food article theme has been chosen. Accordingly, the overall shape of play material container 10 corresponds to a pie segment shape similar to the shape of a segment of a conventional round pizza or the like. In further accordance with this chosen theme, press molds 22, 23 and 24 are configured to provide molded articles which are typical of food and condiment articles found upon various types of pizza foods. In further accordance with the chose theme, die apertures 16 and 17 are elongated and generally rectangular in cross-section allowing the extruded play material formed in accordance with the operation shown in FIG. 2 to generally represent elongated food articles typical of a pizza.

Thus, in accordance with an important aspect of the present invention, the child user is able to access play material 15 by simply opening lid 12 from base 11 and removing cap 30 by unsnapping it. Thereafter, in the manner set forth below in greater detail, the child user is able to form various articles such as a wedge or segment of a pizza by manipulating the play material using lid 12 and base 11 as accessory elements and forming tools.

Figure 2:
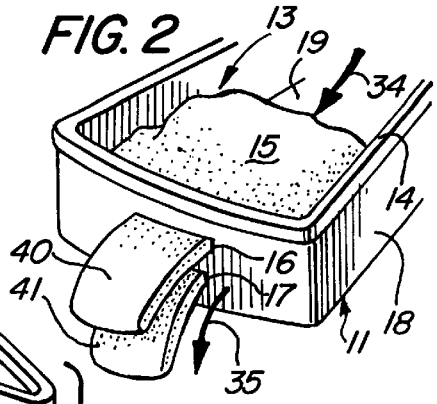
FIG. 2 sets forth a partial rear perspective view of the base portion of the present invention play material container.
Figure 7:
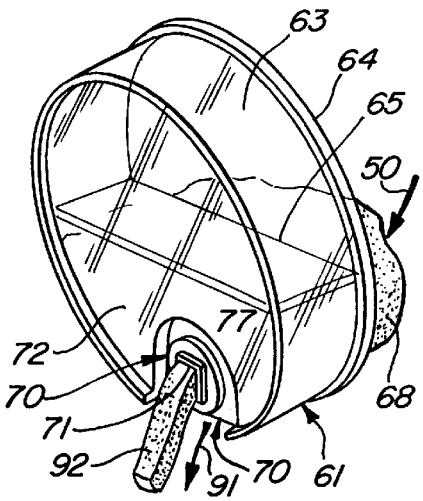
FIG. 7 sets forth a perspective bottom view of the base portion of the present invention play material container operating as an extruder.

FIG. 2 sets forth a partial rear perspective view of base 11 illustrating the extrusion of play material through apertures 16 and 17 thereof. As described above, base 11 defines a sidewall 18, a bottom 19 and a cutter edge 14. As is also described above, sidewall 18 defines a pair of elongated generally rectangular die apertures 16 and 17. In accordance with the extruder play feature of the present invention play material container, a quantity of play material 15 is received within cavity 13 of base 11 and forced against the rear portion of sidewall 18 in the direction indicated by arrow 34. This force is provided directly by the user's hand against play material 15 or, alternatively, a tool such as a spatula or other suitably shaped object may be utilized. As the play material is forced against the rear portion of sidewall 18, the play material is forced outwardly through die apertures 16 and 17 forming extruded articles 40 and 41. Articles 40 and 41 continue to move outwardly in the direction indicated by arrow 35 as the extrusion process continues. At the desired point, articles 40 and 41 may be cut or torn using a suitable tool such as cutter knife 25 to form discrete simulated food articles. It will be apparent to those skilled in the art that while elongated generally rectangular apertures have been chosen in the illustrative embodiment of FIGS. 1 through 5, other differently shaped die apertures may be readily used in the present invention play material container without departing from the spirit and scope of the present invention. Toward this end, it will be noted that a square cross-section extruder die aperture is shown in FIG. 7 in the alternate embodiment of the present invention shown therein.

Figure 3:
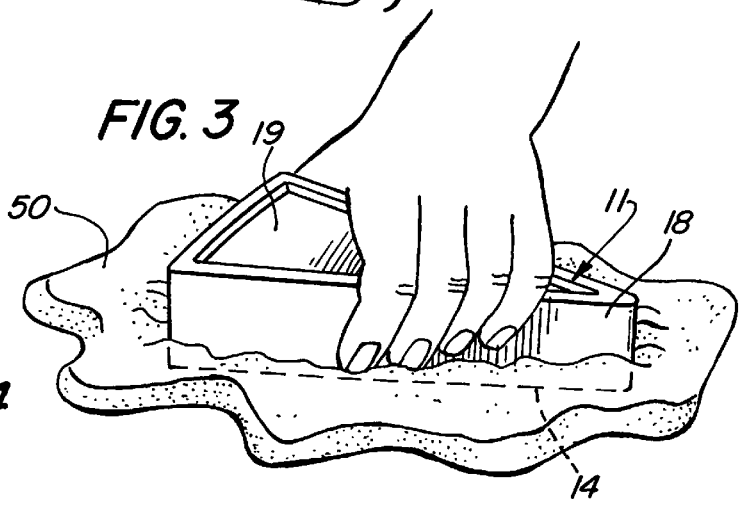
FIG. 3 sets forth a perspective view of the present invention play material container operating as a material cutter.
Figure 5:
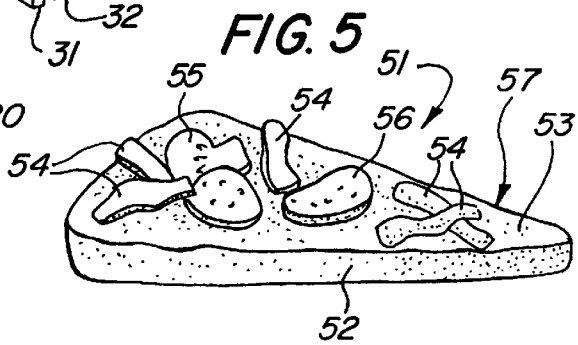
FIG. 5 sets forth a perspective view of an exemplary play material formed article.

FIG. 3 sets forth the use of base 11 in forming the substrate portion of the simulated food article shown in FIG. 5. The operation of forming a simulated food substrate is carried forward using the "cookie-cutter" capability of base 11. Accordingly, a quantity of play material 50 is flattened to form a generally flat pancake of play material larger than the dimensions of base 11. Thereafter, base 11 is inverted such that bottom 19 faces upwardly and sidewall 11 and cutter edge 14 face downwardly toward play material 50. Thereafter, the user simply forces base 11 downwardly in the well known cookie-cutter operation to drive edge 14 through play material 50 forming a correspondingly shaped simulated food article 51 (shown in FIG. 5). Once again, it will be apparent to those skilled in the art that while a pie segment shape has been chosen for base 11, other shapes may readily be utilized without departing from the spirit and scope of the present invention.

Figure 4:
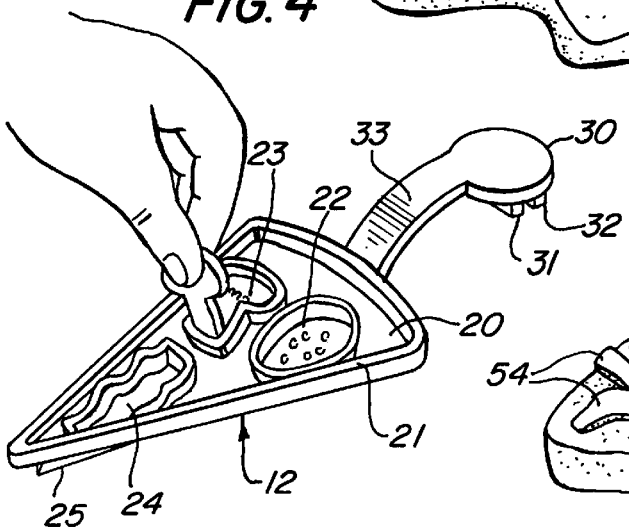
FIG. 4 sets forth a perspective view of the press mold function of the present invention play material container.

FIG. 4 sets forth a perspective view of the operation of press molding various simulated food articles using press molds 22 through 24 in lid 12. More specifically, lid 12 includes a recessed surface 20 and surrounding sidewall 21. Upon surface 20, a plurality of press molds 22 through 24 are supported. As described above, press molds 22 through 24 are shaped for form simulated food articles which carry forward the overall theme of play material container 10. Accordingly, and by way of example, press mold 22 is shaped to form play material articles resembling a slice of sausage or the like. Similarly press mold 23 is shaped to form play material articles representing mushroom slices while press mold 24 is formed to shape play material articles resembling cheese slices.

As described above, lid 12 further includes a flexible hinge strap 33 supporting a cap 30. The latter further supports a pair of seal bars 31 and 32. When not used in the above-described container sealing function, hinge strap 33, cap 30 and seal bars 31 and 32 may serve as a convenient handle for holding lid 12 during the forming of press molded articles.

FIG. 5 sets forth a perspective view of an exemplary simulated food article formed of play material using play material container 10. The exemplary play material simulated food article generally referenced by numeral 51 includes a pie-shaped substrate 57 formed in the cookie-cutter step shown in FIG. 3. Substrate 57 defines an upper surface 53 and an edge 52. A plurality of simulated food articles such as article 55 formed using press mold 23 as shown in FIG. 4, articles 56 formed using press mold 22 in FIG. 4 and articles 54 formed using press mold 24 in FIG. 4 are supported upon surface 53. The completed play material product resembles a segment of a conventional pizza and is preferably formed using play material of different colors.

Thus, it will be apparent to those skilled in the art that the present invention play material container provides a variety of functions and play material patterns useful in enhancing the play value of the malleable play material. It will be equally apparent that the various functions and features of play material container 10 are achieved with little or no additional cost or space beyond the requirements of a more conventional prior art container. Thus, in accordance with an important aspect of the present invention, play material container 10 facilitates a variety of play material activities using implements and accessories which remain together in a compact play material kit within which the play material may be stored. This avoids the frequent problem of prior art devices in which various play material forming articles and accessories become misplaced or lost over time.

Figure 6:
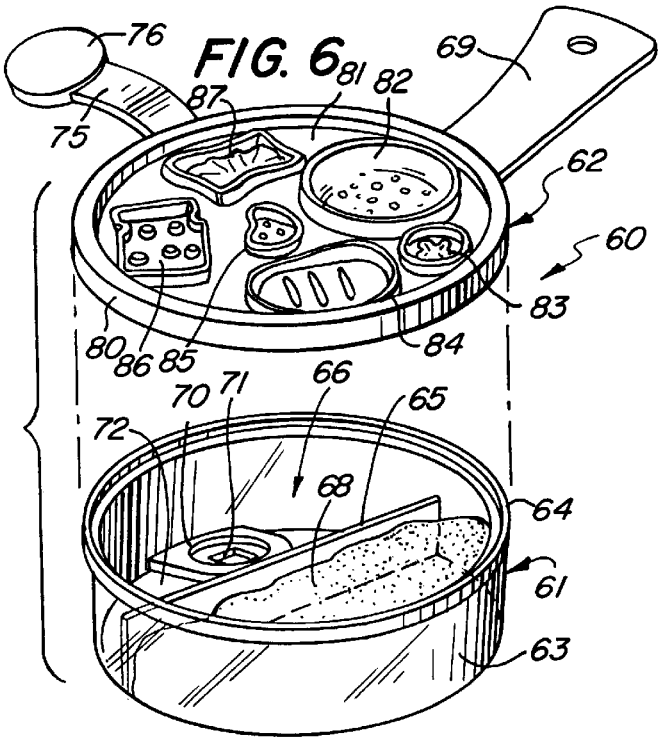
FIG. 6 sets forth a perspective assembly view of an alternate embodiment of the present invention play material container.

FIG. 6 sets forth a perspective assembly view of an alternate embodiment of the present invention play material container generally referenced by numeral 60. Container 60 is similar to container 10 set forth above in that it includes a base 61 having a sidewall 63 and a cutter edge 64. Base 61 further includes a bottom 72 and an interior wall 65. The latter divides the interior of base 61 into a pair of substantially equal cavities 66 and 67. A quantity of play material 68 is supported within cavity 67. Within cavity 66, an extrusion die 70 defining a die aperture 71 is formed in bottom 72.

Lid 62 conforms generally to cutter edge 64 of base 61 and defines a sidewall 80 together with a generally planar surface 81. Sidewall 80 is configured to fit snugly upon the exterior of cutter edge 74 to provide a sealing attachment of lid 62. Lid 62 further includes a handle 69 and a resilient hinge strap 75. Strap 75 in turn supports a cap 76 which is configured to be received upon wall 77 (seen in FIG. 7) of extrusion die 70. Lid 62 further supports a plurality of open faced press molds 82 through 87 extending upwardly from surface 81.

In accordance with the present invention, container 60 is sealed to enclose a quantity of play material by fitting sidewall 80 of lid 62 upon cutter edge 64 of base 61. Thereafter, hinge strap 75 is curved bringing cap 76 into alignment with wall 77 of extrusion die 70 (seen in FIG. 7). Thereafter, cap 76 is forced upon wall 77 in a snap-fit sealing engagement to complete the closure of cavities 66 and 67 of base 61. With lid 62 and cap 76 in place, the interior of container 60 remains air tight and sealed thus preventing any undesired drying of the play material within the container.

When it is desired to utilize container 60 in the above-described play pattern, lid 62 and cap 76 are removed from base 61 and extrusion die 70 respectively exposing the contents of base 61. Among the various play patterns available is the use of extrusion die 70 to fabricate an elongated play material element in the manner set forth in FIG. 7.

FIG. 7 sets forth a perspective bottom view of base 61 of container 60 utilized to provide the play material extrusion feature. Accordingly, and as described above, base 61 defines a sidewall 63, a cutter edge 64 and a bottom 72. The latter defines an extrusion die 70 having an aperture 71 formed therein and having a surrounding wall 77. Base 61 further includes an interior wall 65 which divides the interior of base 61.

In accordance with the present invention, a quantity of play material 68 is forced into base 61 against die aperture 71 of extrusion die 70. Thereafter, the user applies a force against play material 68 in the direction indicated by arrow 50 causing the extrusion of an elongated play material article 92 to be formed outwardly in the direction indicated by arrow 91. The continued application of force against play material 68 maintains the extrusion of article 92 causing it to grow to the desired length. Article 92 may be periodically severed into shorter pieces or allowed to be extruded into a relatively long article.

Figure 8:
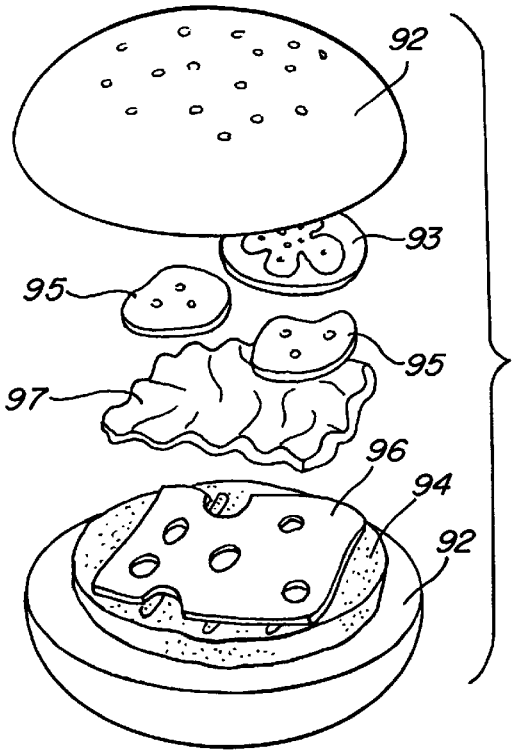
FIG. 8 sets forth a perspective assembly view of an exemplary object formed of malleable play material using the present invention play material container.

FIG. 8 sets forth a perspective assembly view of a simulated food item fabricated of play material utilizing container 60. The elements of the simulated food article shown in FIG. 8 are formed of play material using press molds 82 through 87 of lid 62 (seen in FIG. 6). The simulated food article shown in FIG. 8 is that generally known as a "burger" or hamburger sandwich in which a meat patty and various condiments are enclosed by upper and lower bun portions. Accordingly, a pair of simulated hamburger bun portions 92 are fabricated using press mold 82 of lid 62 shown in FIG. 6. Similarly, the remaining articles of the simulated burger are formed using the various press molds of lid 62. For example, simulated burger patty 94 is formed using press mold 84 while simulated cheese slice 96 is formed using press mold 86. By way of further example, a simulated lettuce leaf 97 is formed using press mold 87 while simulated pickle slices 95 are formed using press mold 85 and simulated tomato slice 93 is formed using press mold 83 of lid 62 (the latter seen in FIG. 6).

Thus, the present invention play material container provides a novel combination of container and forming tool accessory for malleable play material. It will be apparent to those skilled in the art that the two embodiments set forth in FIGS. 1 and 6 are merely illustrative of shapes and configurations in which the present invention container may be formed. Therefore, by way of further example but not limitation, the present invention container may be formed in shapes corresponding in silhouette to creatures such as fish or the like, various facial elements such as clowns or the like, as well as other objects such as flowers or plants without departing from the spirit and scope of the present invention. It should also be noted that the present invention play material container shown utilizes an advantageous theme throughout the container and its accessories which allows the child user to maximize the play value of the container apparatus. In this manner, the shape of the container and its integral cookie-cutter as well as the various elements formed in the press mold formed in the lid of the container together with the extrusion die fabricated within the container base all cooperate to advance a common theme such as a wedge of pizza, a typical burger, or alternatives such as a clown face, a fish or a flower or other selected theme elements. This cooperation of theme elements greatly enhances the play value of the play material used in combination with the container and stimulates the child's interest and amusement.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A play material container and multi-featured toy set comprising:

a base defining a bottom and a base sidewall forming an interior cavity and a cutter edge formed on said sidewall;

a lid defining a surface and surrounding lid sidewall shaped in general correspondence to and compation with said base sidewall, said lid when secured to said base providing closure of said interior cavity;

a plurality of open-faced press molds formed on said surface of said lid, each press mold shaped to form an object;

an extrusion die formed in said side base sidewall having a die aperture formed therein;

a cap formed to snap to said extrusion die and form a seal for said die aperture; and a quantity of amorphous malleable play material stored within said interior cavity, said lid including a resilient hinge strap having one end joined to said lid sidewall and the remaining end joined to said cap.

2. A play material container and multi-featured toy set as set forth in claim 1 wherein said cutter edge is shaped to cut a substrate from a pancake portion of said play material and wherein said objects formed by said press molds define shapes which are related to said substrate such that placing said objects formed by said press molds upon said substrate completes a themed item.

3. A play material container and multi-featured toy set as set forth in claim 2 wherein said base further includes an interior wall joined to said base sidewall and dividing said interior cavity.

4. A play material container and multi-featured toy set as set forth in claim 3 wherein said extrusion die forms an elongated item of play material as said play material is forced through said die aperture.

5. A play material container and multi-featured toy set as set forth in claim 4 wherein said themed item is a simulated pizza segment and wherein said substrate is a simulated pizza crust segment and wherein said objects are simulated condiment items for a pizza.

6. A play material container and multi-featured toy set as set forth in claim 4 wherein said press mold objects include a simulated burger patty, burger bun and burger condiments.

* * * * *